US007067031B2

(12) United States Patent
deWitt

(10) Patent No.: US 7,067,031 B2
(45) Date of Patent: Jun. 27, 2006

(54) PROCESS FOR MAKING A CERAMIC ARMOR PLATE

(75) Inventor: Fabio deWitt, Ottawa (CA)

(73) Assignee: DEW Engineering and Development Limited, Ottawa (CA)

( * ) Notice: Subject to any disclaimer, the term of this patent is extended or adjusted under 35 U.S.C. 154(b) by 124 days.

(21) Appl. No.: 10/725,391

(22) Filed: Dec. 3, 2003

(65) Prior Publication Data

US 2006/0102276 A1 May 18, 2006

(51) Int. Cl.
*B32B 37/00* (2006.01)
*B05D 7/00* (2006.01)
*F41H 5/013* (2006.01)

(52) U.S. Cl. ..... 156/250; 156/267; 156/299; 109/49.5; 109/82; 224/121; 2/2.5; 102/303

(58) Field of Classification Search ..... 156/63, 156/256, 258, 265, 300, 299, 512, 250, 267; 109/49.5, 80, 82; 244/121; 2/2.5; 102/303; 428/911; 89/36.02, 36.01, 36.16, 36.09, 89/36.08, 36.07, 36.11, 36.04, 36.12
See application file for complete search history.

(56) References Cited

U.S. PATENT DOCUMENTS

| | | | | |
|---|---|---|---|---|
| 1,465,767 | A * | 8/1923 | Krause | 428/55 |
| 3,977,294 | A * | 8/1976 | Jahn | 89/36.02 |
| 4,648,215 | A | 3/1987 | Hashish et al. | |
| 4,955,164 | A | 9/1990 | Hashish et al. | |
| 5,173,138 | A * | 12/1992 | Blauch et al. | 156/177 |
| 5,515,541 | A * | 5/1996 | Sacks et al. | 2/2.5 |
| 5,733,643 | A * | 3/1998 | Green | 428/217 |
| 5,860,849 | A | 1/1999 | Miller | |
| 6,170,378 | B1 * | 1/2001 | Neal et al. | 89/36.05 |
| 6,408,733 | B1 * | 6/2002 | Perciballi | 89/36.02 |
| 6,601,783 | B1 | 8/2003 | Chisum et al. | |

FOREIGN PATENT DOCUMENTS

| | | |
|---|---|---|
| CA | 1199799 | 1/1986 |
| CA | 1231235 | 1/1988 |
| CA | 1287564 | 8/1991 |
| CA | 1296993 | 3/1992 |
| CA | 1319317 | 6/1993 |

OTHER PUBLICATIONS

FEDTECH website: http://www.fedtech.com (pages of particular relevance attached).
LAI Companies website: http://www.laico.com (pages of particular relevance attached).

* cited by examiner

*Primary Examiner*—Linda Gray
(74) *Attorney, Agent, or Firm*—Freedman & Associates

(57) ABSTRACT

Disclosed is a process for making a ceramic armor plate. A backing element having a known two-dimensional size is provided. A plurality of ceramic armor tiles are placed side by side to form a layer of ceramic armor tiles on a front surface of the backing element, and the layer of ceramic armor tiles is affixed to the backing element. An abrasivejet cutter is used to cut continuously through at least two adjacent ceramic armor tiles of the affixed layer of ceramic armor tiles, and through a corresponding portion of the backing element affixed thereto, so as to delineate a portion of a ceramic armor plate.

17 Claims, 5 Drawing Sheets

PROCESS FOR MAKING A CERAMIC ARMOR PLATE

The instant invention relates generally to armor plates of the type that are commonly mounted to a vehicle or a craft for providing protection from objects such as high speed projectiles, and more particularly to an improved process for making ceramic armor plates from a plurality of individual ceramic tiles.

One of the ways of protecting an object from a projectile is by equipping that object with armor. The armor may vary in shape and size to fit the object that is to be protected. A number of materials e.g. metals, synthetic fibers, and ceramics have been used in constructing these armors. The use of ceramics in constructing armors has gained popularity because of some of the useful properties that ceramics possess. In general, ceramics are inorganic compounds with a crystalline or glassy structure. While being rigid, ceramics are low in weight in comparison with steel; are resistant to heat, abrasion, and compression; and have high chemical stability. Two most common shapes in which ceramics have been used in making armors are as pellets/beads and tiles, each having its own advantages and disadvantages. Typically, ceramic tiles have a size of 1"×1", 2"×2", 3"×3", or 4"×4". Typical ceramic tiles are approximately 0.25 inches to 0.5 inches in thickness, but other thickness may be used in dependence upon the nature of the protection that is desired.

Often, ceramics are used as part of a composite armor system. A known type of composite armor system may generally include two basic elements, namely: a base (backing) element for particle containment which may comprise a plurality of layers of fibrous material embedded in a resinous matrix; and an energy absorbing body (comprising, for example, one or more layers of material such as ceramic tiles, etc.) disposed on the frontal face of the base element, the energy absorbing body being impact shatterable for absorbing kinetic energy of a projectile.

The major energy absorption for such a two part composite occurs on impact of the projectile with an element of the energy absorbing body. On impact kinetic energy is dissipated by inducing the shattering of the energy absorbing element, such as a ceramic tile, and transferring kinetic energy to the so created debris of the element over a wide area relative to the area of the projectile. The projectile itself fragments as it passes through the debris, which tends to be held in place by the underlying base element, thus dissipating more kinetic energy. The particles (or fragments) of projectile and energy absorbing element (e.g. ceramic tile) are then contained by the base element, such containment also absorbing kinetic energy.

Of course, when a second projectile strikes the composite armor there is an increased probability of penetration. Accordingly, multi-hit armor is known, i.e. one that can withstand more than one projectile impact. For this purpose, the armor is made of separate tiles connected together, as by gluing onto the base element. A projectile hitting the armor may destroy one or more tiles at a time, and the remaining tiles serve to prevent penetration over the remaining surface of the armor.

When the multi-hit armor is to be mounted onto a vehicle, such as for instance a car, a truck, a tank, a helicopter or other aircraft, a ship or other sea worthy vessel, or an amphibious vehicle, it is beneficial to provide the armor as a plate having a shape similar to a portion of the vehicle that is to be protected. Often, the desired shape may be complex, having sides of different lengths, and/or sides meeting at different angles, etc. The prior art process for making such a multi-hit armor plate includes the steps of cutting the base element to the desired shape, individually cutting a plurality of ceramic tiles, and assembling the cut ceramic tiles onto the cut base element. When the assembly is glued and suitably processed, a composite multi-hit armor plate having the desired shape is obtained. Unfortunately, these plates are generally expensive to manufacture, since each ceramic tile must be laboriously cut to the correct size and fit onto the base element. Typically, diamond saws are used for cutting the ceramic tiles, in dependence upon the hardness of the ceramic tiles. In addition, the base element may be formed using two or more separate layers, each of which layers is cut to the desired shape prior to being glued and suitably processed together to form the base element. Typically, one or more of a laser, an abrasivejet, shearing and cutting means is used to cut the separate layers.

It is a disadvantage that some of the above-mentioned cutting methods may generate heat within the ceramic tile armor plate, which may reduce the hardness or other desirable properties of the armor plate within the heat affected zone. Alternatively, transfer of particles from the cutting method into the ceramic tile may occur, also possibly reducing the hardness or other desirable properties of the armor plate within the affected zone.

It would be advantageous to provide a process for making ceramic armor plates that overcomes the above-mentioned limitations of the prior art.

It would be further advantageous to provide a process for making ceramic armor plates requiring a single-pass cut.

It would be further advantageous to provide a process for making ceramic armor plates that obviates the need to use a plurality of different cutting apparatii.

SUMMARY OF THE INVENTION

In accordance with an aspect of the instant invention there is provided a process for making a ceramic armor plate, comprising: affixing a plurality of ceramic armor tiles side by side to form a fixed layer of ceramic armor tiles having a known two-dimensional size; and, using an abrasivejet cutter, cutting continuously through at least two adjacent ceramic armor tiles of the affixed layer of ceramic armor tiles, so as to delineate a portion of a ceramic armor plate, the ceramic armor plate having a two-dimensional size that is smaller than the known two-dimensional size.

In accordance with another aspect of the instant invention there is provided a process for making a ceramic armor plate, comprising: providing a backing element having a known two-dimensional size; placing a plurality of ceramic armor tiles side by side to form a layer of ceramic armor tiles; affixing the layer of ceramic armor tiles to the backing element with an adhesive; and, using an abrasivejet cutter, cutting continuously through at least two adjacent ceramic armor tiles of the affixed layer of ceramic armor tiles and through a corresponding portion of the backing element affixed thereto, so as to delineate a portion of a ceramic armor plate, the ceramic armor plate having a two-dimensional size that is smaller than the known two-dimensional size of the backing element.

Exemplary embodiments of the invention will now be described in conjunction with the following drawings, in which similar reference numbers designate similar items:

Figure 4A:
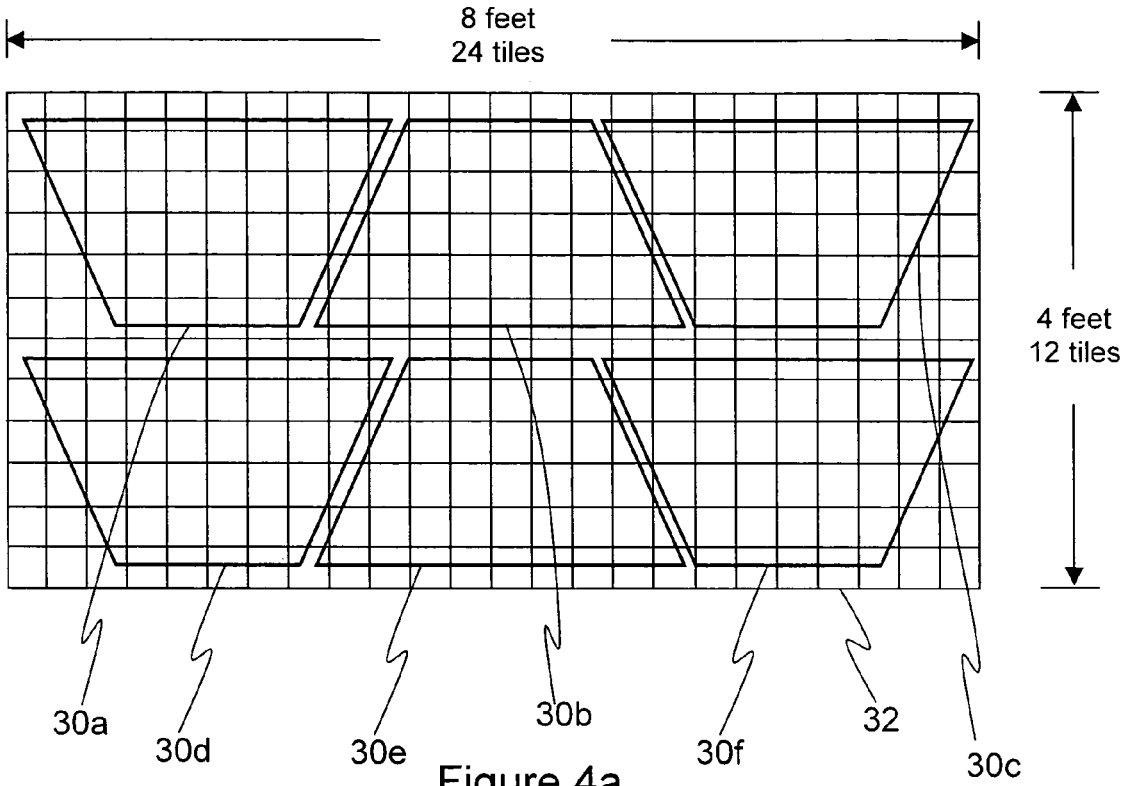
Figure 4B:
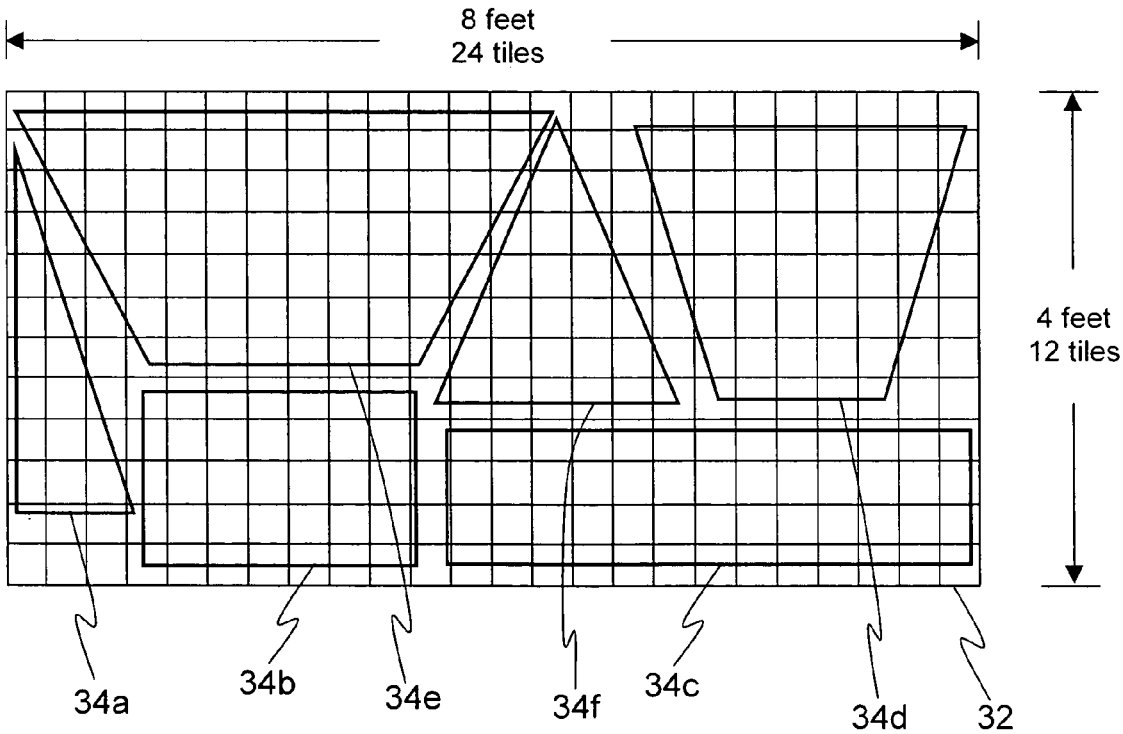
Figure 4C:
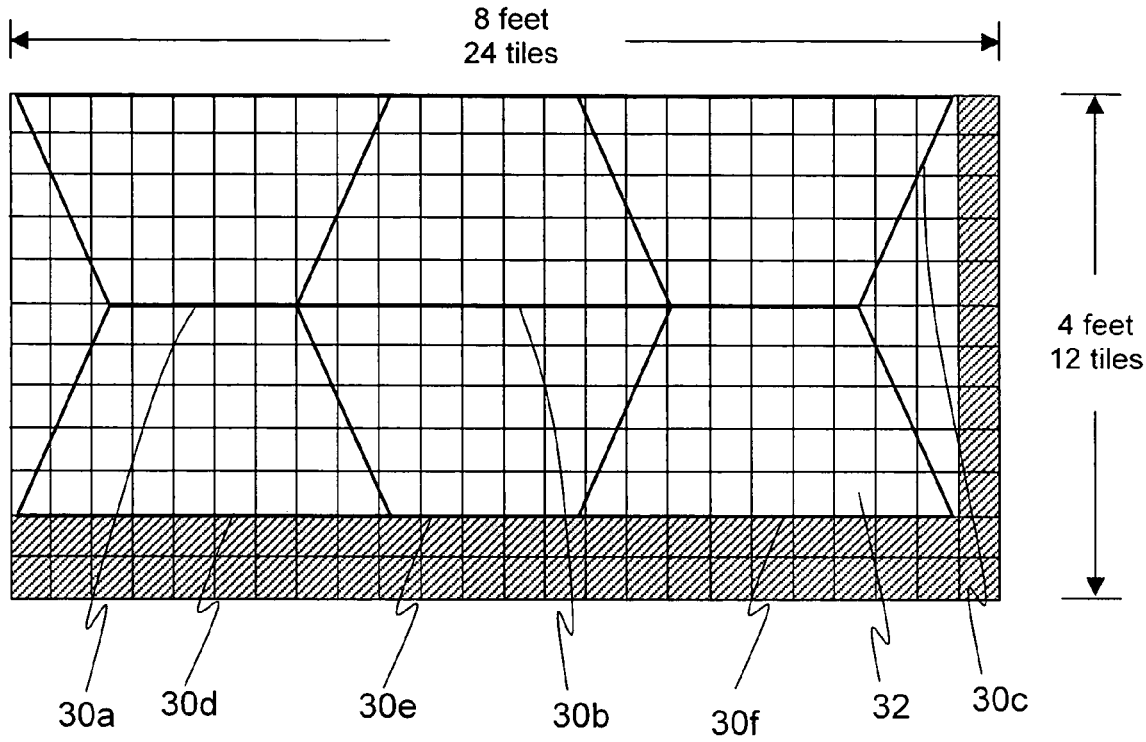
Figure 4D:
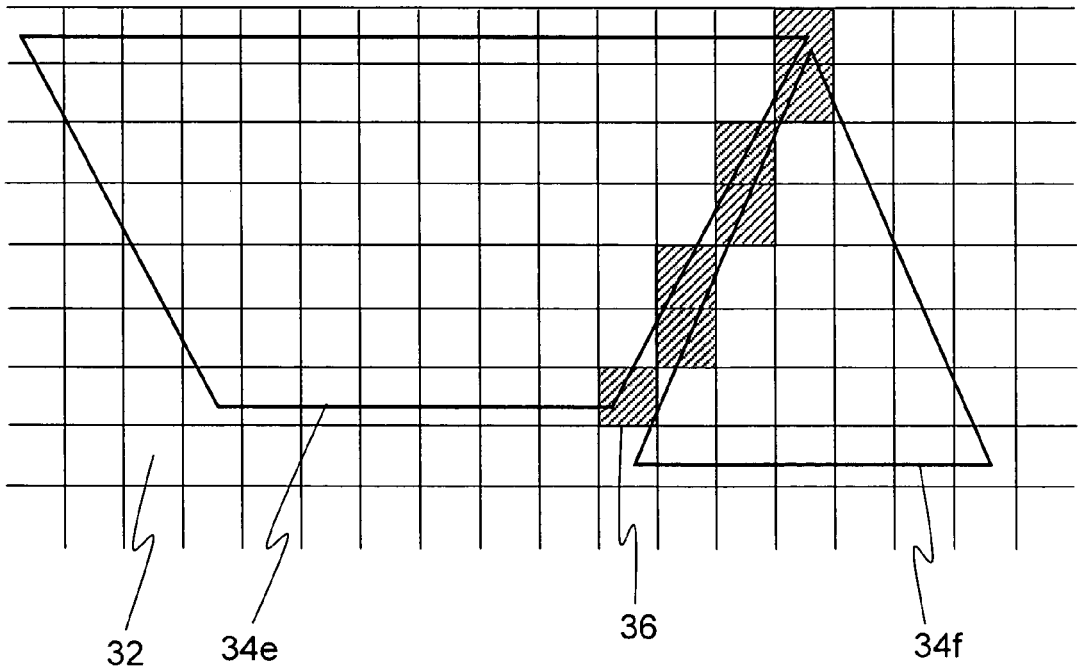

FIG. 4*a* is a schematic top view showing a plurality of similarly shaped armor plates nested within a large sheet of ceramic-tile composite-armor;

FIG. 4*b* is a schematic top view showing a plurality of differently shaped armor plates nested within a large sheet of ceramic-tile composite-armor;

FIG. 4*c* is a schematic top view showing a plurality of similarly shaped armor plates nested in a close-packing arrangement within a large sheet of ceramic-tile composite-armor;

FIG. 4*d* is an enlarged schematic top view showing two of the differently shaped armor plates of FIG. 4*b;*

Figure 5:
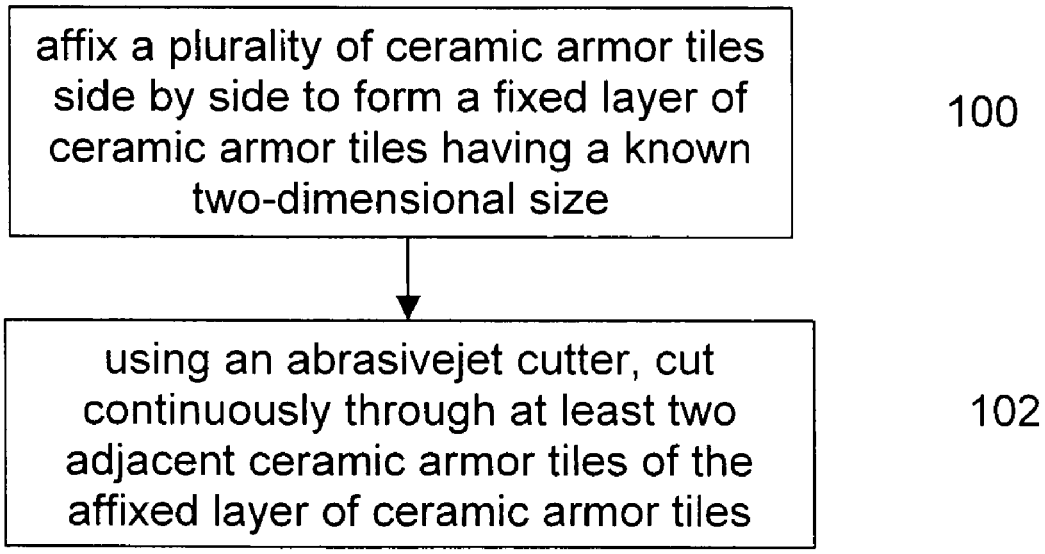
Figure 6:
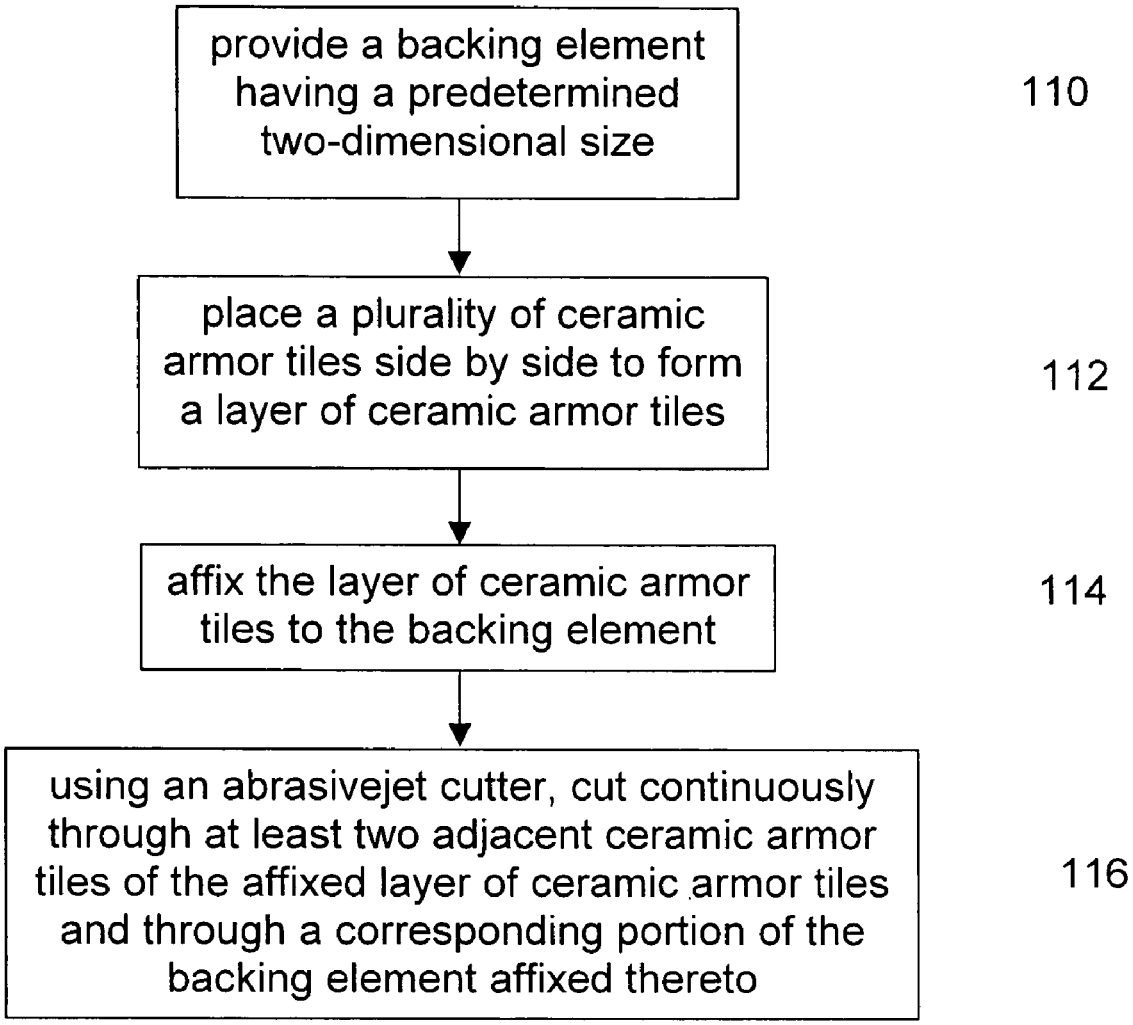

FIG. 5 is a simplified flow diagram of a process according to an embodiment of the instant invention; and, FIG. 6 is a simplified flow diagram of a process according to another embodiment of the instant invention.

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein. Throughout the detailed description and in the claims that follow, it is to be understood that the following definitions shall be accorded to the following terms. The term 'base element' means a support material, more specifically a backing material, for supporting a plurality of individual ceramic tiles. The 'base element' optionally includes a plurality of adjacent layers, with an adhesive material disposed between adjacent layers of the plurality of adjacent layers. Optionally, at least some of the adjacent layers of the plurality of adjacent layers are a ballistic material, such as for example a material including an aramid fiber.

According to an embodiment of the instant invention, a plurality of individual ceramic armor tiles (for instance, each tile is approximately 3"×3" or 4"×4" and approximately 0.25 inches to 0.5 inches in thickness) is affixed to a base element, so as to form a large (i.e. 4 foot by 8 foot) sheet. Nested shapes, corresponding to the ceramic armor plates, are cut from the large sheet using an abrasivejet cutter. For example, the abrasivejet includes water and an abrasive material such as at least one of garnet, alumina and another suitable abrasive media. In particular, the abrasivejet cutter is used to cut approximately continuously through at least two adjacent ceramic armor tiles of the plurality of ceramic armor tiles. Optionally, the size and shape of the large sheet is selected to support tight nesting of the ceramic armor plates, so as to minimize material wastage.

Figure 1:
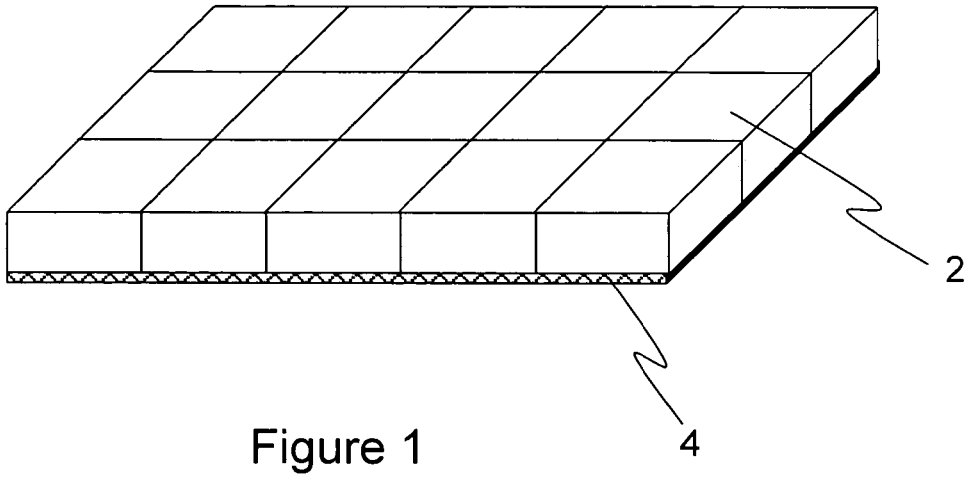
FIG. 1 is a simplified isometric view of a plurality of ceramic armor tiles affixed side by side to form an affixed layer of ceramic armor tiles having a known two-dimensional size.

Referring to FIG. 1, shown is a simplified isometric view of a plurality of ceramic armor tiles affixed side by side to form a layer of ceramic armor tiles having a known two-dimensional size. Notably, each ceramic armor tile 2 is affixed to a base element 4 prior to the ceramic armor tiles 2 being cut. For example, a layer of adhesive is applied between the plurality of ceramic armor tiles and the base element, with subsequent processing. As illustrated in FIG. 1, each ceramic armor tile 2 is abutted closely against every other adjacent ceramic armor tile. In this way, the formation of connection lines or spaces between individual ceramic armor tiles, which are weakened points from a ballistic point of view, is minimized. While the base element 4 is shown in FIG. 1 as a single layer, it is to be understood that the base element 4 typically includes a plurality of separate layers of material, at least some of which are typically a ballistic material such as for example a material including an aramid fiber.

Figure 2:
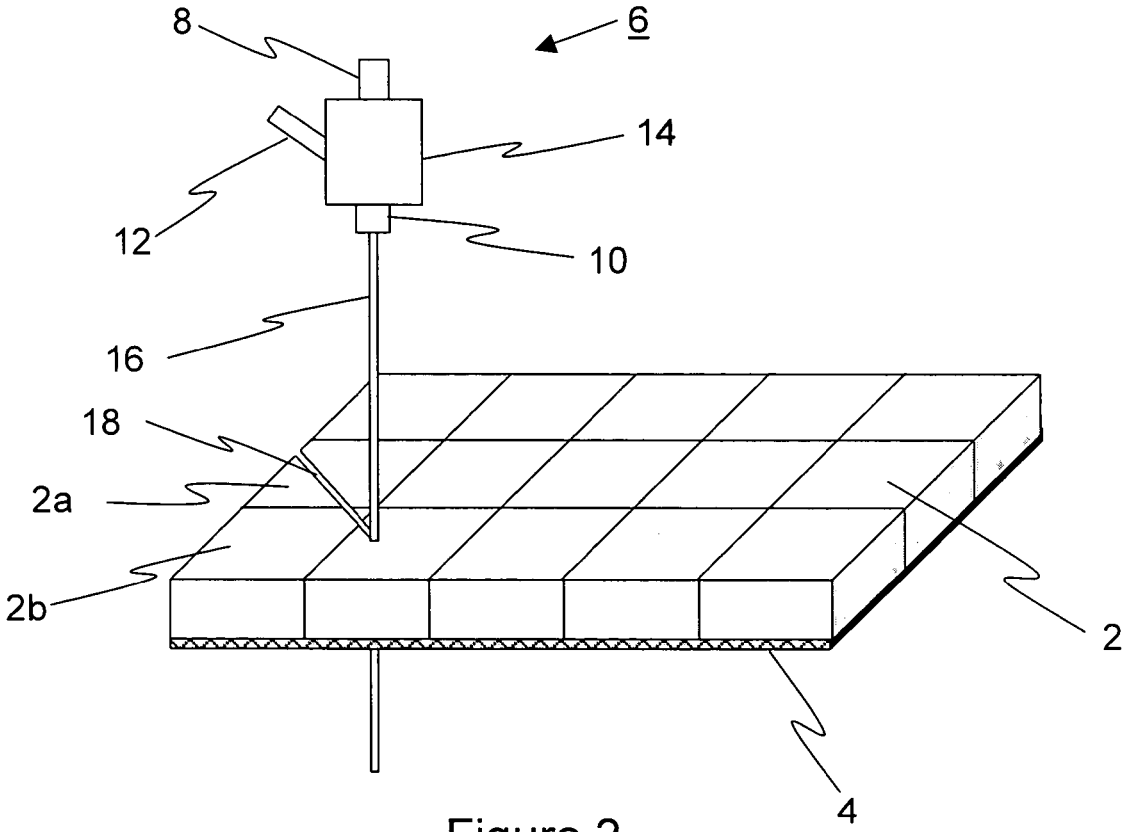
FIG. 2 is a simplified isometric view showing an abrasivejet cutting through a portion of the affixed layer of ceramic armor tiles.

Referring now to FIG. 2, shown is a simplified isometric view of an abrasivejet cutting through a portion of the fixed layer of ceramic armor tiles, according to an embodiment of the instant invention. The abrasivejet cutting head 6 includes a member 8 having a fluid passageway aligned with an abrasivejet discharge nozzle 10. An abrasive-carrying conduit 12 provides an abrasive material (having a predetermined particle size and flow rate) to the mixing region 14, in which the abrasive is entrained into the waterjet. Typically, in an abrasivejet cutter the discharge nozzle 10 includes an orifice (not shown) with a diameter between 0.001 and 0.050 inches with operating pressures from 5,000 to 100,000 psi and above. Optionally, other orifice sizes and operating pressures may also be used. Of course, other suitable arrangements for forming an abrasivejet 16 may be envisaged, as for example are disclosed in U.S. Pat. No. 4,648,215, which is incorporated herein by reference.

Referring still to FIG. 2, the abrasivejet cutting head 6 discharges a stream of abrasive-laden fluid 16 through the not shown orifice. The stream of abrasive-laden fluid 16 is used to form a continuous cut 18 through at least two adjacent ceramic armor tiles 2*a*, 2*b* of the affixed layer of ceramic armor tiles 2, and through a portion of the base element 4 disposed therebelow.

Figure 3:
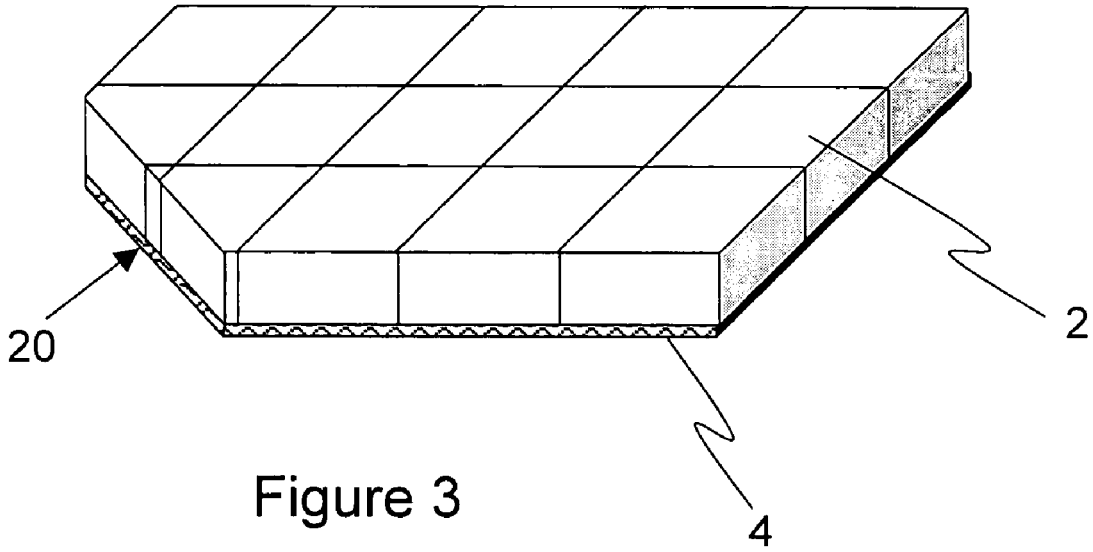
FIG. 3 is a simplified isometric view showing the affixed layer of ceramic armor tiles subsequent to being cut and with the cut portion removed.

Referring now to FIG. 3, shown is simplified isometric view showing the affixed layer of ceramic armor tiles subsequent to being cut and with the cut portion removed. The section 20, which is exposed by making the continuous cut 18 through the at least two adjacent ceramic armor tiles 2*a*, 2*b* of the affixed layer of ceramic armor tiles 2, delineates a portion of an edge of a ceramic armor plate having a desired or predetermined shape. Advantageously, section 20 is exposed using a single cut, such that an edge of each of the cut-through layers is substantially flush with an edge of every other cut-through layer. While the section 20 is exposed using a linear cut, it is also envisaged that curved cuts optionally are used to expose other curved sections along the edge of the ceramic armor plate, in dependence upon the actual desired or predetermined shape.

Referring now to FIG. 4*a*, shown is a schematic top view showing a plurality of similarly shaped armor plates 30*a*–30*f* nested within a large sheet of ceramic-tile composite-armor 32. In the example that is shown at FIG. 4*a*, an array of 12 four-inch square ceramic armor tiles by 24 four-inch square ceramic armor tiles is provided to form a four by eight foot layer of ceramic armor tiles. Conveniently, the separate layers of the base element (not illustrated) are available in such a four by eight foot format. Optionally, the separate layers of the not illustrated base element are glued together and suitably processed prior to the layer of ceramic armor tiles being affixed thereto, either performed on site or prior to the base element being purchased. Further optionally, the separate layers of the base element are arranged one on top of another, with layers of adhesive applied between adjacent layers, and the layer of ceramic armor tiles is arranged on top of the base layer, with a layer of adhesive applied between the ceramic armor tiles and the base layer. Once arranged, the layer of ceramic armor tiles and the base layer are suitably processed to form the ceramic-tile composite-armor. Optionally, different sized ceramic armor tiles and/or different a number of ceramic armor tiles are used to make the large sheet of ceramic-tile composite-armor 32.

The shapes 30*a*–30*f* are cut from the large sheet of ceramic-tile composite-armor 32 using the stream of abrasive-laden fluid 16 described with reference to FIG. 2. Advantageously, the shapes 30*a*–30*f* are nestable, such that material waste is minimized. In particular, the abrasivejet cutter is capable of making continuous straight or curved cuts through plural ceramic armor tiles along any direction. Optionally, one of a computer numerical control (CNC) machine and an automated jig is used to control the abrasivejet cutter. Of course, other control systems may also be used.

Referring now to FIG. 4*b*, shown is a schematic top view showing a plurality of differently shaped armor plates 34*a*–34*f* nested within a large sheet of ceramic-tile composite-armor 32. In the example that is shown at FIG. 4*b*, an array of 12 four-inch square ceramic armor tiles by 24 four-inch square ceramic armor tiles is provided to form a four by eight foot layer of ceramic armor tiles. Conveniently, the separate layers of the base element (not illustrated) are available in such a four by eight foot format. Optionally, the separate layers of the not illustrated base element are glued together and suitably processed prior to the layer of ceramic armor tiles being affixed thereto, either performed on site or prior to the base element being purchased. Further optionally, the separate layers of the base element are arranged one on top of another, with layers of adhesive applied between adjacent layers, and the layer of ceramic armor tiles is arranged on top of the base layer, with a layer of adhesive applied between the ceramic armor tiles and the base layer. Once arranged, the layer of ceramic armor tiles and the base layer are suitably processed to form the ceramic-tile composite-armor. Optionally, different sized ceramic armor tiles and/or different a number of ceramic armor tiles are used to make the large sheet of ceramic-tile composite-armor 32.

The shapes 34*a*–34*f* are cut from the large sheet of ceramic-tile composite-armor 32 using the stream of abrasive-laden fluid 16 described with reference to FIG. 2. Advantageously, the shapes 34*a*–34*f* are nestable, such that material waste is minimized. In particular, the abrasivejet cutter is capable of making continuous straight or curved cuts through plural ceramic armor tiles along any direction. Optionally, an automated jig is used to control the abrasivejet cutter. Of course, other control systems may also be used.

Referring now to FIG. 4*c*, shown is a schematic top view showing a plurality of similarly shaped armor plates 30*a*–30*f* nested in a close-packing arrangement within a large sheet of ceramic-tile composite-armor 32. FIG. 4*c* is similar to FIG. 4*a*, but the shapes 30*a*–30*f* are nested so as to minimize material wastage and to minimize the number of cuts required. In particular, relative to FIG. 4*a* the close-packing nesting of shapes avoids cutting through 58 ceramic armor tiles, a 20% materials cost savings. In other words, the six shapes 30*a*–30*f* may be cut from a sheet of ceramic-tile composite-armor measuring 3'4" by 7'8", or only 10×23 four inch tiles.

In addition, the total number of cuts that are required to cut the six shapes 30*a*–30*f* is greatly reduced. For example, a single cut forms one edge on each of shapes 30*a* and 30*b*. Similarly, a different single cut forms one edge on each of shapes 30*a* and 30*d*.

Furthermore, there is an additional and unobvious materials savings cost relative to the prior art methods, in which tiles are individually cut and subsequently pieced together to form armor plates having a desired shape. In particular, a portion of a cut armor tile is always "waste" when using the prior art method, since only some of the tile is eventually used to piece together the armor plate. It is an advantage of some embodiments of the instant invention that, by nesting similar or different shapes in a same large sheet of ceramic-tile composite-armor 32, a same ceramic armor tile often can be "shared" between two adjacent nested shapes, with a portion of the ceramic armor tile forming a portion of one of the two adjacent nested shapes, and with a different portion of the ceramic armor tile forming a portion of the other one of the two adjacent nested shapes. In other words, the prior art required cutting two separate ceramic armor tiles in order to obtain two utilizable portions, whereas the instant invention supports cutting a single ceramic armor tile into two utilizable portions.

Referring now to FIG. 4*d*, shown is an enlarged schematic top view showing two of the differently shaped armor plates of FIG. 4*b*. Highlighted ceramic armor tiles 36 are ones which are shared between the two different shapes 34*e* and 34*f*. Accordingly, for the particular nesting of shapes shown at FIG. 4*b* and at FIG. 4*d*, a savings of up to 7 ceramic armor tiles is realized for forming only two edges, one edge along each shape 34*e* and 34*f*. It is expected that such savings will be greater when cutting shapes of greater complexity, for example shapes having many corners, since the prior art methods are more likely to render portions of a ceramic armor tile unusable when plural cuts, made at an angle one to the other, are required. Abrasivejet cutters, on the other hand, are capable of precisely cutting a complex shape from a ceramic armor tile, without damaging other portions of the ceramic armor tile.

Referring now to FIG. 5, shown is a simplified flow diagram of a process according to an embodiment of the instant invention. At step 100, a plurality of ceramic armor tiles is affixed, side by side, to form a fixed layer of ceramic tiles having a known two-dimensional size. At step 102, an abrasivejet cutter is used to cut continuously through at least two adjacent ceramic armor tiles of the affixed layer of ceramic armor tiles. Preferably, the fixed layer of ceramic tiles is affixed to a backing element prior to step 102. For example, an adhesive is used to affix the layer of ceramic tiles to the backing element. Optionally, the backing element includes a plurality of separate layers affixed one to another to form the backing element. Further optionally, step 102 is performed under one of manual, semi-automated and fully automated control. Still further optionally, affixing a plurality of ceramic armor tiles side by side to form a fixed layer of ceramic armor tiles having a known two-dimensional size involves a step of applying an adhesive between adjacent ceramic armor tiles. In this way, the fixed layer of ceramic armor tiles having a known two-dimensional size optionally is cut using the abrasivejet cutter prior to being affixed to the backing element.

Referring now to FIG. 6, shown is a simplified flow diagram of a process according to another embodiment of the instant invention. At step 110, a backing element having a predetermined two-dimensional size is provided. In one non-limiting example, the backing element is provided as a four by eight foot sheet of the backing element. At step 112, a plurality of ceramic armor tiles is placed, side by side, to form a layer of ceramic tiles. At step 1114, the layer of ceramic armor tiles is affixed to the backing element. For example, a layer of an adhesive is applied between the layer of ceramic armor tiles and the backing element. At step 116, an abrasivejet cutter is used to cut continuously through at least two adjacent ceramic armor tiles of the affixed layer of ceramic armor tiles and through a corresponding portion of the backing element affixed thereto. Optionally, the backing element includes a plurality of separate layers affixed one to another to form the backing element. Further optionally, step 116 is performed under one of manual, semi-automated and fully automated control.

It is an advantage of the processes according to the instant invention that the ceramic armor tiles are assembled into a large sheet prior to being cut to a desired shape. In particular, it is less labor intensive (and therefore cheaper) to assemble square ceramic armor tiles into a large sheet compared to cutting the ceramic armor tiles first and then assembling the cut tiles to form a ceramic armor plate of a desired shape. Furthermore, by using an automated jig or the like, reproducibility of the cuts, and therefore reliability of the armor plates, is improved.

It is a further advantage of the processes according to the instant invention that the force that is exerted by the abrasivejet cutter is in a direction approximately normal to the surface of the ceramic tiles in the large sheet. This force does not impose any "unexpected" stress on the adhesive layers that hold the individual ceramic tiles to the backing material. In contrast, using a diamond saw blade according to the prior art (or another type of mechanical saw) to cut a large sheet into armor plates of a desired shape results in laterally directed stresses to the adhesive layers, which may loosen the tiles from the backing material, which may reduce the anti-ballistic properties of the armor plates, etc. In addition, assembling the tiles first into a large sheet and then cutting the sheet to form desired shapes minimizes the formation of weak spots or "ballistic holes" (i.e. along the edges of adjacent ceramic tiles), especially in the vicinity of the cut.

It is yet another advantage of the processes according to the instant invention that the abrasivejet cutter may be used to cut ceramic armor plates of virtually any desired shape from a large sheet of the ceramic armor tiles. In particular, the abrasivejet cutter supports both straight (linear) and curved cuts, and supports two or more adjacent straight cuts meeting at any angle. Accordingly, armor plates shapes (similar or different) may be nested closely within the large sheet of the ceramic armor tiles, since the abrasivejet cutter is capable of tracing around an outline to cut out virtually any shape. Such tight nesting is not possible using a diamond saw, for example, since the diamond saw supports only straight cuts, and therefore a cut made along the edge of a first shape is likely to continue through a portion of an adjacent nested shape. Furthermore, once a first nested shape is completely cut out, the abrasivejet may be rapidly moved to begin cutting out a next nested shape, without needing to reposition the large sheet of ceramic tiles. Moving the abrasivejet to a next nested shape is performed optionally by shutting off the abrasivejet cutter during the rapid movement and thereby leaving the material intermediate the two shapes intact, or by operating the abrasivejet during the rapid movement and thereby cutting the material intermediate the two shapes.

Further advantageously, the same tool (i.e. the abrasivejet cutter) may be used to cut the ceramic armor plates of a desired shape from the large sheet of ceramic tiles, and may also be used to bore holes through a portion of the ceramic armor plate for accommodating mounting hardware, and/or to cut sections from the ceramic armor plate for accommodating windows or other structures along the region of the vehicle that is to be protected by the ceramic armor plate.

Still further advantageously, angling the abrasivejet cutting head supports cutting of the large sheet of ceramic armor tiles at an angle (other than 90°) to the surface, so as to provide a beveled edge along at least a portion of the edge of the ceramic armor plate. Providing opposing beveled edges along overlapping portions of adjacent ceramic armor plates supports slight overlapping of the adjacent ceramic plates, thereby reducing probability of projectile penetration at the joints between adjacent ceramic armor plates.

It is an advantage of an embodiment of the instant invention that, during manufacture of a large number of ceramic armor plates, the cutting pattern is varied easily such that no two plates are cut in substantially the same way. In other words, capturing a vehicle equipped with a ceramic armor plate made using a process according to an embodiment of the instant invention, and analyzing the captured ceramic armor plate to determine localized ballistic weak spots along the surface thereof, does not reveal information relating to localized ballistic weak spots along the surface of other ceramic armor plates made using the process according to an embodiment of the instant invention.

Numerous other embodiments may be envisaged without departing from the spirit and scope of the invention.

What is claimed is:

1. A process for making a ceramic armor plate, comprising:

affixing a plurality of ceramic armor tiles side by side to form a fixed layer of ceramic armor tiles having a known two-dimensional size; and, using an abrasivejet cutter, cutting continuously through at least two adjacent ceramic armor tiles of the affixed layer of ceramic armor tiles, so as to delineate a portion of a ceramic armor plate, the ceramic armor plate having a two-dimensional size that is smaller than the known two-dimensional size.

2. A process according to claim 1, comprising prior to cutting continuously through at least two adjacent ceramic armor tiles, affixing the fixed layer of ceramic armor tiles to a backing element with an adhesive.

3. A process according to claim 2, wherein cutting continuously through at least two adjacent ceramic armor tiles of the fixed layer of ceramic armor tiles includes cutting through a corresponding portion of the backing element affixed thereto.

4. A process according to claim 1, wherein affixing a plurality of ceramic armor tiles side by side to form a fixed layer of ceramic armor tiles having a known two-dimensional size comprises applying an adhesive between adjacent ceramic armor tiles of the plurality of ceramic armor tiles.

5. A process according to claim 3, wherein the ceramic armor plate having a two-dimensional size that is smaller than the known two-dimensional size is selected from a plurality of ceramic armor plates each having a same two-dimensional size that is smaller than the known two-dimensional size, each ceramic armor plate of the plurality of ceramic armor plates being nested within a same fixed layer of ceramic armor tiles.

6. A process according to claim 3, wherein the ceramic armor plate having a two-dimensional size that is smaller than the known two-dimensional size is selected from a plurality of ceramic armor plates, at least some of which having a different two-dimensional size that is smaller than the known two-dimensional size, each ceramic armor plate of the plurality of ceramic armor plates being nested within a same fixed layer of ceramic armor tiles.

7. A process according to claim 3, wherein cutting continuously through at least two adjacent ceramic armor tiles of the affixed layer includes cutting continuously along a straight path through at least two adjacent ceramic armor tiles of the affixed layer.

8. A process according to claim 3, wherein cutting continuously through at least two adjacent ceramic armor tiles of the affixed layer includes cutting continuously along a curved path through at least two adjacent ceramic armor tiles of the affixed layer.

9. A process according to claim 1, wherein each ceramic armor tile of the plurality of ceramic armor tiles is approximately four inches by four inches.

10. A process according to claim 1, wherein each ceramic armor tile of the plurality of ceramic armor tiles is approximately three inches by three inches.

11. A process for making a ceramic armor plate, comprising:

providing a backing element having a known two-dimensional size;

placing a plurality of ceramic armor tiles side by side to form a layer of ceramic armor tiles;

affixing the layer of ceramic armor tiles to the backing element with an adhesive; and, using an abrasivejet cutter, cutting continuously through at least two adjacent ceramic armor tiles of the affixed layer of ceramic armor tiles and through a corresponding portion of the backing element affixed thereto, so as to delineate a portion of a ceramic armor plate, the ceramic armor plate having a two-dimensional size that is smaller than the known two-dimensional size of the backing element.

12. A process according to claim 11, wherein the ceramic armor plate having a two-dimensional size that is smaller than the known two-dimensional size is selected from a plurality of ceramic armor plates each having a same two-dimensional size that is smaller than the known two-dimensional size, each ceramic armor plate of the plurality of ceramic armor plates being nested within a same fixed layer of ceramic armor tiles.

13. A process according to claim 11, wherein the ceramic armor plate having a two-dimensional size that is smaller than the known two-dimensional size is selected from a plurality of ceramic armor plates, at least some of which having a different two-dimensional size that is smaller than the known two-dimensional size, each ceramic armor plate of the plurality of ceramic armor plates being nested within a same fixed layer of ceramic armor tiles.

14. A process according to claim 11, wherein cutting continuously through at least two adjacent ceramic armor tiles of the affixed layer includes cutting continuously along a straight path through at least two adjacent ceramic armor tiles of the affixed layer.

15. A process according to claim 11, wherein cutting continuously through at least two adjacent ceramic armor tiles of the affixed layer includes cutting continuously along a curved path through at least two adjacent ceramic armor tiles of the affixed layer.

16. A process according to claim 11, wherein each ceramic armor tile of the plurality of ceramic armor tiles is approximately four inches by four inches.

17. A process according to claim 11, wherein each ceramic armor tile of the plurality of ceramic armor tiles is approximately three inches by three inches.

* * * * *